US006410099B1

(12) United States Patent
Loncar, Jr.

(10) Patent No.: US 6,410,099 B1
(45) Date of Patent: Jun. 25, 2002

(54) READILY REPLACEABLE IMAGE GRAPHIC WEB

(75) Inventor: Francis V. Loncar, Jr., St. Joseph Township, St. Croix County, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 08/930,957

(22) PCT Filed: May 3, 1997

(86) PCT No.: PCT/US97/03490

§ 371 (c)(1),
(2), (4) Date: Oct. 3, 1997

(87) PCT Pub. No.: WO98/39759

PCT Pub. Date: Sep. 11, 1998

(51) Int. Cl.[7] ..... B05D 1/04

(52) U.S. Cl. ..... 427/466; 427/256; 427/270; 427/271; 427/282

(58) Field of Search ..... 428/99, 100; 24/442, 24/306, 443, 444, 445, 446, 447, 449, 450, 451, 452; 427/282, 256, 466, 258, 261, 270, 271; 8/445, 495

(56) References Cited

U.S. PATENT DOCUMENTS

| | | | | | |
|---|---|---|---|---|---|
| 3,718,725 | A | * | 2/1973 | Hamano | 264/163 |
| 4,070,779 | A | | 1/1978 | Gilmour | 40/575 |
| 4,338,800 | A | * | 7/1982 | Matsuda | 66/194 |
| 4,734,298 | A | * | 3/1988 | Kikukawa | 427/256 |
| 4,761,318 | A | | 8/1988 | Ott et al. | 428/85 |
| 4,930,237 | A | | 6/1990 | Oliphant | 40/617 |
| 4,973,326 | A | | 11/1990 | Wood et al. | 604/391 |
| 5,024,015 | A | | 6/1991 | Quarles, Jr. | 40/605 |
| 5,066,289 | A | | 11/1991 | Polski | 604/389 |
| 5,077,870 | A | * | 1/1992 | Melbye et al. | |
| 5,172,504 | A | | 12/1992 | Maat et al. | 40/605 |
| 5,196,266 | A | | 3/1993 | Lu et al. | 428/355 |
| 5,312,387 | A | | 5/1994 | Rossini et al. | 604/389 |
| 5,316,849 | A | | 5/1994 | Lu et al. | 428/355 |
| 5,482,755 | A | | 1/1996 | Manning | 428/95 |
| 5,554,146 | A | | 9/1996 | Niederhofer et al. | 604/391 |
| 5,622,389 | A | * | 4/1997 | Courtney | |
| 5,800,909 | A | * | 9/1998 | Nitta | |
| 6,250,005 | B1 | * | 6/2001 | Richards | |

FOREIGN PATENT DOCUMENTS

| | | | |
|---|---|---|---|
| EP | 0 249 717 | 12/1987 | G09F/7/02 |
| EP | 0 426 359 | 5/1991 | A44B/18/00 |
| WO | WO 94/23610 | 10/1994 | A44B/18/00 |
| WO | WO 95/21439 | 8/1995 | G09F/11/15 |
| WO | WO 96/03954 | 2/1996 | A61F/13/58 |
| WO | WO 96/21413 | 7/1996 | A61F/13/62 |
| WO | WO 97/06018 | 2/1997 | B44C/5/04 |

* cited by examiner

*Primary Examiner*—Fred J. Parker
(74) *Attorney, Agent, or Firm*—James D. Christoff

(57) ABSTRACT

A method of providing an image graphic mating web having an imageable major surface and an opposing major surface having a nonadhesive substrate mating surface. Substrate mating surfaces include surfaces that employ at least one element of mechanical fasteners such as hook and loop fasteners.

11 Claims, 1 Drawing Sheet

READILY REPLACEABLE IMAGE GRAPHIC WEB

FIELD OF INVENTION

This invention relates to readily replaceable image graphics.

BACKGROUND OF INVENTION

Image graphics are omnipresent in modern life. Images and data that warn, educate, entertain, advertise, etc. are applied on a variety of interior and exterior, vertical and horizontal surfaces. Nonlimiting examples of image graphics range from posters that advertise the arrival of a new movie to warning signs near the edges of stairways.

Readily replaceable image graphics are needed for those occasions when the length of time the graphic needs to remain at the intended location is limited to a short duration, often with a replacement image graphic substituting for the image graphic to be removed. An example of an expected replacement image graphic is the movie poster identified above.

Readily replaceable image graphics require both the "staying power" when placed on the horizontal or vertical surface and the "leaving ease" when the image graphic is to be removed. Among different kinds of readily replaceable image graphics are films that have an image on one major surface and a field of adhesive on the opposing major surface. Again, movie posters and other bills are often adhered to a surface. If the adhesive is pressure sensitive and capable of being readily removed without leaving adhesive residue, then the poster can be posted with staying power and removed with leaving ease.

However, not all surfaces are not amenable to pressure sensitive adhesives. In these circumstances, the adhesive contact interface with the surface can fail prematurely. Inadequate staying power is worse than inadequate leaving ease. Therefore, pressure sensitive adhesives on films can be formulated to overcompensate for the possibility of inadequate staying power on uneven or low energy surfaces where pressure sensitive adhesives can have the most difficulty remaining adhered for the intended duration.

Mechanical fasteners are also another method of erecting graphic images. Methods such as staples or tacks have limited utility, as many surfaces are not amenable to such fastening techniques, or the underlying surface will become damaged by the fasteners. Other methods such as frames with friction clips (on many transport buses), windowed cases, or poster boards made of natural (i.e., cork) or synthetic materials (i.e., polystyrene foam) can also be used for replacement graphics. However, these approaches have the limitation of requiring a substantial initial investment to place the first graphic. Further, the graphic is limited in size by the mounting method. In the case of a frame, the size of the graphic must be controlled to within a few millimeters, or the frame will not hold the graphic. All of the above methods suffer from the fact that the fastener detracts from the graphic images, and in many cases the fastener detracts from the impact of the graphic.

SUMMARY OF INVENTION

The present invention solves problems in the art of providing readily replaceable image graphics by avoiding the use of pressure sensitive adhesives on the major surface opposite the image surface yet providing a mating or meshing action with a substrate, i.e., "substrate mating surface".

The present invention solves problems in the art by providing an image graphic mating web comprising a major surface comprising an imageable area and an opposing major surface comprising a nonadhesive substrate mating surface.

The present invention also solves the problem of traditional mechanical fasteners by hiding the fastening method behind the graphic image.

Nonlimiting examples of substrate mating surfaces include surfaces that employ at least one element of mechanical fasteners in mating systems as are marketed under the brands VELCRO® (Velcro USA, Inc., Manchester, N.H.); SCOTCHMATE® (3M, St. Paul, Minn.); and DUAL LOCK® (3M) and as are also disclosed in U.S. Pat. Nos. 4,761,318; 4,973,326; 5,066,289; 5,077,870; 5,196,266; 5,312,387; 5,316,849; 5,537,722; 5,554,146; European Patent Publication 0 426 359; and PCT Patent Publications WO 9603954 and WO 9621413.

Desirably, the invention uses a mechanical fastener element where the head of the element is larger than the stem in at least one direction traverse to the stem. Nonlimiting examples of mechanical fastener elements meeting this description are included in the disclosures and products identified in the paragraph immediately above, and particularly include stem/head mechanical fastener elements such as hooks in the shape of an "inverted J", a "T", and other configurations.

Preferably, the invention is comprised of, but not limited to, a flexible polyolefin material that is shaped on the substrate contact surface into capped posts that resemble mushrooms (referred to herein as "mushroom-type hooks"). The imageable surface opposing side is smooth and is capable of being processed to accept an image graphic.

Nonlimiting examples of processing capable of making the major surface imageable include surface modification techniques such as Corona Treatment; liquid coatings dissolved or suspended in either organic solvents or water; or a 100% solids polymeric material that can be extruded or coextruded onto the surface.

The image can be formed by any conventional method. Nonlimiting examples include solvent based inks, 100% solids ultraviolet curable inks, inkjet printing, thermal transfer imaging and electrostatic transfer imaging.

An image graphic mating web of the present invention can then be mated to a substrate that has at least a portion of its surface comprising a companion mating element, whether a companion element to a mechanical fastener or a loop structure that interacts with hooks of the substrate mating surface of the image graphic mating web.

Preferably, the nature of mating described as "hook and loop" systems forms the bond. Nonlimiting examples of such systems are disclosed in U.S. Pat. Nos. 4,973,326; 5,066,289; 5,077,870; 5,196,266; 5,312,387; 5,316,849; 5,537,722; 5,554,146; European Patent Publication 0 426 359; and PCT Patent Publications WO 9603954 and WO 9621413; and copending, coassigned U.S. patent application Ser. No. 08/611,351 (Johnson et al.); the disclosures of which are incorporated by reference herein.

One advantage of hook and loop systems is that the loop portion of the system can be a conventional material used in a conventional setting, such as carpeting, fabric wall coverings, woven and non-woven materials designed to accept the hook portion of the system. Alternatively, the loop portion can be removably attached to a desired surface.

A further advantage of the loop system is that the higher internal strength of many loop systems compared to most films and paper substrates allows the use of a pressure sensitive with higher "staying power", while still affording relatively clean and easy removal. In addition, the mating loop can be supplied with any number of pressure sensitive adhesives with various levels of "staying power", to match the characteristics of the underlying surface. Further, the loop can be fastened by alternative methods such as nails, staples, tacks or even wet adhesives in water and/or organic solvents that can be applied by methods such as brushing, troweling, spraying or self-contained aerosol cans.

The advantage of the "hook and loop" system is that no matter how the loop is attached to the underlying surface, the mating action of the loop with the hook remains unaffected. In practical terms, this means the printer or graphic image producer needs only to stock one type of imageable hook substrate that can be used for a large variety of applications.

An image graphic mating web of the present invention can be mated with a loop portion and later removed, in order to mount a new graphic. This process can be repeated for the life of the webs, which can vary from a few to thousands of applications.

A feature of this invention over the prior art is that the image graphic mating web is designed to be the printable substrate for the graphic. Among the advantages of the invention that flow from this feature are the following:

1. Compared to conventional pressure sensitive adhesive (PSA) graphic webs, the image graphic mating web does not require a coating of PSA, or a silicone coated liner. The elimination of the silicone coated liner serves two purposes: (a) the liner is an costly component of the graphic film that is discarded after application of the graphic; and (b) a bulky used liner creates disposal or recycling problems for the user of the graphic. In other words, the web of present invention produces less waste during production, and less waste during installation.
2. The image graphic mating web is faster to install than a PSA coated graphic, and this method allows for a more predictable removal. While the image graphic mating web does require a loop structure to be applied first, even the need for this step would not involve a significant time penalty to the graphic installer, because the loop is much easier to install than a PSA film graphic. Further, because the loop is hidden by the graphic image, small defects can be tolerated, and larger defects such as wrinkles can be cut out and replaced. In fact, exact placement and squareness are not as critical because the loop can be mounted in a larger size than ultimately needed, and subsequently can be trimmed square to the proper size. After the initial installation of the loop, mounting of the image graphic mating web is extremely fast, even for a novice installer.
3. An image graphic mating web is more easily repositionable and removable. Current PSA graphic films require an expert installer to achieve a defect-free application, and even in the hands of a person skilled in the art, the repositionable feature can be limited. Further, the PSA graphic films can not be removed and reused under normal circumstances, due to the fact that the film is distorted during removal and the fact that the PSA must be protected during storage. In contrast, an image graphic mating web can be mounted and repositioned a number of times until the desired result is achieved.
4. The mechanical fastening aspect of the image graphic mating web allows for maximum bond strength to be achieved immediately, while allowing for easy removal without distorting the graphic long after the graphic has been mounted. Theoretically, this time interval is only limited by the working life of the webs.

Image graphic mating webs also have a number of advantages over the current art of using hook and loop materials for graphic applications. The current art of using mechanical fastening is typified in U.S. Pat. Nos. 4,930,237; 5,024,015; 5,172,504; and 5,482,755. Each of these patents is similar in that small pieces of hook and loop material are added to the finished graphic. The size of the hook and loop fastening varies, or is not specified, but is shown in the drawings typically to be 5% or less of the area occupied by the graphic. In contrast to these approaches, image graphic mating webs have a number of advantages:

1. Since the bonding is continuous over the entire graphic, application is very easy, and no stretching or tensioning is required to eliminate wrinkles or sagging.
2. The continuous coverage allows for flaws in the bonding of the loop to the target surface without causing a catastrophic failure. The current art of using small pieces of hook and loop web means that the stress of the graphic is concentrated on small areas of adhesive, generally a PSA. Any adhesive failure results in a catastrophic failure of the graphic.
3. The image graphic mating web is very thin and lightweight which on large graphics is an important ergonomic consideration.
4. The image graphic mating web is flexible, which makes it easy to transport and install. In comparison, much of the current art requires a rigid graphic web, or a rigid frame, both of which are more difficult to transport.
5. The image graphic mating web is manufactured by a simple polymer extrusion process, where the image receptor layer can be coextruded onto the surface, or can be coated onto the polymer surface at a later time. This process is low waste and economical compared to building up a suitable product by adhesively bonding two or more separate components. Further, since the web is made from thermoplastic materials, recyclablility is enhanced.
6. An installer of the image graphic mating web receives the web ready-to-image. There is no need to attach the hook material to the graphic after imaging. The web can be processed by the customer in a similar manner to the PSA graphics.

Other features and advantages will be considered with the following embodiments described using the following drawings.

EMBODIMENTS OF INVENTION

Figure 1:
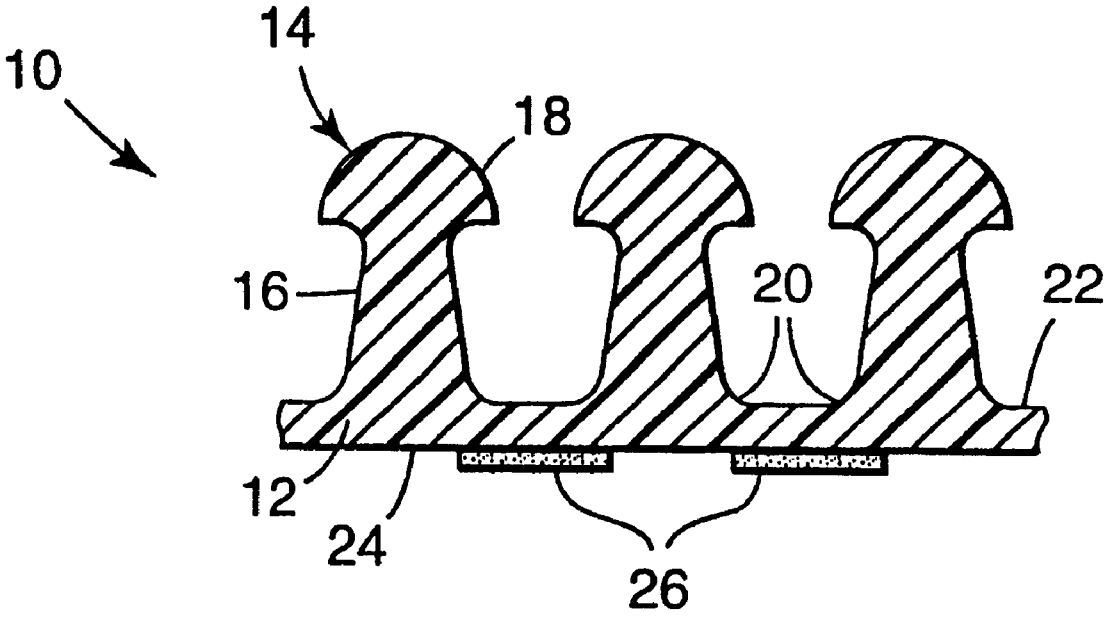
FIG. 1 is a cross-sectional view of an image graphic mating web of the present invention having an image thereon.

FIG. 1 illustrates one embodiment of the invention that shows an image graphic mating web 10 having a substantially continuous backing 12 of thermoplastic resin. Integral with the backing is an array of mushroom-shaped projections or hooks 14, each having a molecularly oriented stem 16, a mushroom head 18, and a fillet 20 at the base of the stem. A piece of the web 10 can be the hook portion of a hook-and-loop mechanical fastener, or it can be releasably fastened to a fabric which is penetratable by the mushroom-shaped hooks 14, or it can be configured such that two pieces of the web 10 can be interengaged to form a hermaphroditic mechanical fastener. The web is substantially shown and described in U.S. Pat. No. 5,077,870, the disclosure of which is incorporated by reference herein.

The web 10 has the hooks 14 serving as its substrate mating surface 22. On the opposing major surface, the substantially continuous backing has an imageable surface 24. An image 26 on at least a portion of surface 24 is shown, while it is to be understood that an image can cover from 0.01–100% of the total area of surface 24 depending on the type of image to be displayed.

Mating Surface

Mushroom-type hooks 14 are disposed in a selected arrangement (it is preferred that this arrangement be a predetermined pattern) on backing 12, and are formed to have a generally uniform height projection from the backing 12. The selected arrangement for surface stem dispersal is preferably a uniform array, although any arrangement of surface stems is possible (including even a randomly designed dispersal of surface stems within a given area). In a preferred embodiment, the mushroom-type hooks 14 are arrayed in staggered rows across the backing 12,. Preferably, each hook 14 projects at a right angle relative to surface 22, but alternatively angled stem orientations are also contemplated.

Preferably, the mushroom-type hooks 14 and backing 12 are formed integrally, and the web 10 requires no additional support layer or backing material. As shown, the hooks 14 of the preferred embodiment are equally spaced apart. The hooks 14 collectively serve to define an operative region or contact surface for mating with the substrate. The hooks 14 provide a very uniform frictional engaging surface for presentation to the substrate to be contacted.

The use of uniformly disposed and formed hooks 14 on mating surface 22 results in a highly controllable and predictable engagement relationship between the web and the substrate (e.g., floor, wall, ceiling in an interior or exterior environment). In addition, the precisely formed nature of the mating surface introduces a significant mechanical engagement component into the frictional engagement relationship. The upstanding hooks 14 penetrate interstices on the web surface of the substrate (e.g., between the crossed fibers of its weave for a woven web such as carpet or a woven wall covering or a tape affixed to either having a woven outer surface) to engage the web mechanically.

The web 10 can be molded from a number of commercially available materials. Nonlimiting examples of moldable material useful for web 10 having hooks 14 thereon include SRD7-560 and SRD70587 impact copolymer resins (available from Shell Polypropylene Company, Houston, Tex.); PREVAIL® 3050 resin (available from Dow Chemical Company, Midland, Mich.); HIMONT® KS084P resin (Montell-Himont, Atlanta, Ga.); and HYTREL® 5526 or SURLYN® 1702 resin (both available from E. I. du Pont de Nemours & Co., Inc., Wilmington, Del.).

Other configurations are useful. For example, stem-shaped projections generally described in copending, coassigned U.S. patent application Ser. No. 08/611,351 (Johnson et al.) (incorporated by reference herein) can also be used in this invention. The stems can vary according to a number of parameters. Further aspects of mating surface 22 are described according to a combination of stem height, stem diameter, stem spacing and number of stems per $cm^2$. Four examples of these parameters for the web 10 are listed in Table I below:

TABLE I

| Item | Stem Density (stems/$cm^2$) | Substrate Thickness (cm) | Stem Height (cm) | Stem Diameter (cm) | Stem Spacing (cm) |
|---|---|---|---|---|---|
| A1 | 50 | 0.013 | ~0.094 | ~0.041 | ~0.140 |
| A2 | 50 | ~0.013 | ~0.064 | ~0.038 | ~0.140 |
| A3 | 149 | ~0.010 | ~0.015 | ~0.108 | ~0.081 |
| A4 | 357 | ~0.008 | ~0.015 | ~0.013–0.018 | ~0.053 |

The parameters listed in Table I are not meant to be limiting, and numerous variations in those parameters are possible for a particular web. For instance, the stem density is preferably greater than 12 stems/$cm^2$, and more preferably greater than 15 stems/$cm^2$. Table I presents specific stem density examples of 50, 149 and 357 stems/$cm^2$, but stem web stem densities greater than 357 stems/$cm^2$ are also possible. Further, the surface stems may have a height gradient (e.g., shorter in center than near its ends) in order to facilitate handling, the stems may not be round in cross-section, and the stem density and/or stem spacing may vary. In some applications, it may even be desirable that adjacent stems have different heights, or to have stems which change in profile (i.e., cross-section) along their height (e.g., a cylindrical stem having an enlarged, tapered stem base).

Web 10 of the present invention is typically formed by molding a flowable material to form hooks 14 seen in FIG. 1 according to the techniques described in U.S. Pat. No. 5,077,870 (Melbye et al.) or stems as described in application Ser. No. 08/611,351 (Johnson et al.). The flowable material can be any suitable material, such as a polymer, a metal or a ceramic precursor. It is also within the scope of this invention to use two or more different flowable materials to make the surface stems, one which can form hooks 14 and the other which can form imageable surface 24.

The flowable material is a foamed or solid polymeric material (such as that described above), such as a thermoplastic material or a thermosetting material. Other suitable materials include thermoplastic polyurethanes, polyvinyl chlorides, polyamides, polyimides, polyolefins (e.g., polyethylene and polypropylene), polyesters (e.g., polyethylene terephthalate), polystyrenes, nylons, acetals, block polymers (e.g., polystyrene materials with elastomeric segments, available from Shell Chemical Company of Houston, Tex., under the designation KRATON®, polycarbonates, thermoplastic elastomers, and copolymers and blends thereof. The flowable material may also contain additives including but not limited to fillers, fibers, antistatic agents, lubricants, wetting agents, foaming agents, surfactants, pigments, dyes, coupling agents, plasticizers, suspending agents and the like.

Imageable Surface

Surface 24 requires characteristics that permit imaging using at least one of the known imaging techniques. Nonlimiting examples of imaging techniques include solvent based inks, 100% solids ultraviolet curable inks, water based inkjet printing, thermal transfer, and electrostatic transfer imaging.

Nonlimiting examples of processing capable of making the surface 24 receptive to imaging include surface modification techniques such as Corona Treatment; liquid coatings dissolved or suspended in either organic solvents or water; or a 100% solids polymeric material that can be extruded or coextruded onto the surface either during or after formation of web 10 as described above.

Nonlimiting examples of liquid coatings include ethylene vinyl acetate dispersions, alkyd resins in organic solvent, acrylate and urethane acrylate coatings in water or organic solvents, polyvinyl chloride in organic solvent, and all of the above combined with inorganic materials such as talc, clays, silica and pigments.

Nonlimiting examples of extrudable or coextrudable polymeric materials include ethylene vinyl acetate polymers, acrylate modified ethylene vinyl acetate polymers, vinyl chloride polymers, neutralized ethylene acrylic acid polymers, and all of the above combined with inorganic materials such as clays, talcs and pigments.

Including the projection of hooks 14 from surface 12, the thickness of web 10 can range from about 0.008 cm to about 0.200 cm, and preferably from about 0.013 cm to about 0.120 cm.

Usefulness of the Invention

Webs 10 of the present invention combine the best of both utilities of imaging and releasable attachment on their opposing major surfaces. Mechanical fastening can comprise any portion of mating surface 12 and imaging can comprise any portion of imageable surface 24.

Using such imaging techniques as SCOTCHPRINT® Electronic Graphics System available from 3M, (which includes either in electrostatic transfer or inkjet means of image formation), exceedingly precise and beautiful images can be formed on surface 24 for display via mating of web to a substrate using mating surface 12.

Further embodiments are disclosed in the Examples.

EXAMPLE 1

Polypropylene material (SRD 70587 from Shell Co., Houston, Tex.) was extruded as described with reference to FIG. 3 with approximately 50 pins/cm$^2$, and capped into mushroom-type hooks by the methods outlined in U.S. Pat. No. 5,077,870. This material was slit down to 30.5 cm wide rolls, were air Corona Treated on the smooth side at approximately 15 watts/cm (Corona Treater Model DP-9007, Lepel Corp., Maspeth, N.Y.). Onto this web, DuPont BYNEL® 3101 acrylate modified ethylene-vinyl acetate resin was extruded onto the smooth side using an extruder with a die temp of 238° C. The BYNEL® 3101 was extruded at a thickness of 0.003 cm at a melt temperature of 227° C. at 6.1 meters/min. The extrusion took place at a heated nip where the Chrome roll was heated to 121° C. and the rubber backup roll was kept at 10° C. This was done to maximize the bond between the smooth Corona Treated polypropylene surface and the BYNEL® 3101, without distorting the hook structure on the reverse side.

EXAMPLE 2

The web as prepared in Example 1 was cut into 30.5 cm by 30.5 cm sheets and screen printed with 3M 9715 Red UV Screen Printing Ink. The ink was screen printed using a 390T screen, and cured with a medium pressure mercury vapor focused UV lamp system at 168 mJ/cm$^2$. (American Ultraviolet Co., Murray Hill, N.J.). Print quality was excellent, and no major defects were observed. The graphic could then be mounted onto fabric cover was such as found in office cubicles and trade shows, onto level loop carpeting, or onto a target loop substrate made of Milliken 858028 knitted loop material that was bonded to a rigid substrate using either an aerosol adhesive (3M Spray 77, 3M, St. Paul, Minn.), or a tackified Shell Kraton PSA, many examples of which are known in the art. In each case, the web was applied using a PA-1 applicator (3M) using moderate pressure. The best application technique was to start in the middle of the graphic and work towards the edges using a moderate pressure on the applicator so as to slightly stretch the graphic as it is applied. This provided a very positive bonding situation. Removal was accomplished by using a fingernail to start a corner of the graphic, and peel using moderate hand force. The graphic could then be reapplied or stored until needed. The same graphic was applied and removed several times with no decrease in the function of the hooks.

Ink adhesion was evaluated using the Tape Snap test, which is a modified version of ASTM D-3359. The Tape Snap Test consists of scoring the ink layer with the corner of a single edge razor blade without damaging the underlying print surface, making lines approximately 1 cm apart in a cross-hatched pattern. A piece of Scotch 610 tape (3M) approximately 10 cm long is applied to the cross-hatched area using a PA1 applicator (3M), bonding approximately 8 cm of the tape to the ink, leaving one end free to be grabbed by the tester. The tape is held by one hand of the tester while the other hand keeps the graphic stationary. The tape is peeled back at approximately 180° as rapidly as possible by the tester. An excellent result is when no ink is removed by the tape; a good result is when small (5% or less) is removed; a poor result is when significant portions of the ink are removed (5%–25%); a failure is when nearly all the ink is removed. The Tape Snap Test on this ink gave an excellent result, no ink being removed.

EXAMPLE 3

A web was tested as in Example 2, except the ink was 3M 3905 Black Solvent-based Screen Printing Ink. The screen in this case was a 160 mesh and the ink was cured in an oven at 65.5° C. for 10 minutes. Application and removal were the same as in Example 2, and no degradation in the ink image was observed. Anchorage of the ink to the film through the Tape Snap Test was excellent.

EXAMPLE 4

A hook material was prepared by the same process as in Example 1, except that the number of hooks per square cm was increased to 387. BYNEL® 3101 was extruded onto the smooth side as in Example 1. The resulting material was cut into 30.5 cm by 30.5 cm squares. A sample of printed SCOTCHPRINT Transfer media 8601 was placed print side down onto the smooth, imageable surface of the web. This construction was fed through a 3M Model C hot laminator set at 0.44 kPa, 96° C. and a feed rate of 0.45 m/min. Upon completion of the lamination, the 8601 silicone paper was removed, and a complete transfer of the image had been transferred to the imageable surface of the web. Visual examination indicated that 100% transfer was achieved, with no apparent degradation of print quality.

EXAMPLE 5

A sample of material as prepared in Example 1 was printed by the same method as in Example 4, except that the pressure was reduced to 0.68 kPa, the feed rate was reduced to 15.2 cm/min, and a pad consisting two layers of paper towels (PREMIER Brand, Scott Paper Co., Philadelphia, Pa. 19113), were placed under the hook side of the sample. Visual examination indicated that approximately 95% of the image was transferred to the smooth side of the hook material. The areas of non-transfer were small, pinhole-like voids, that were only visible upon close examination.

EXAMPLE 6

Example 4 was repeated except that SCOTCHPRINT® transfer media 8603 was used. Visual examination indicated 100% transfer was achieved.

EXAMPLE 7

Example 5 was repeated, except that SCOTCHPRINT® Transfer Media 8603 was used. The conditions on the laminator were changed to 0.138 kPa and 45.6 cm/min. Visual examination indicated that a 100% transfer was achieved.

EXAMPLE 8

A sample of material as described in Example 1 was coated with a two layer injet receptor coating as described in PCT Publication WO 96/08377. The first layer was coated using a handspread knife coater set at a 0.011 cm gap, and dried at 93° C. for 10 minutes. The second layer was coated at 0.011 cm gap and dried in the same fashion. The completed sample film was then printed on a NOVAJET III inkjet printer using American Inkjet Inks. An excellent image was obtained, and no feeding problems were observed with the hook graphic material.

EXAMPLES 9

A sample of material as described in Example 1 was fed through a GERBER Edge Printing System (Gerber Scientific Products, Manchester, Conn. 06040), where thermal transfer is used as the print system. Good transfer was obtained on the web except for where the pin for each hook joined the flat film. At each juncture, a very fine pinhole of no ink coverage was observed as seen in Example 5. Otherwise, no defects or distortions were noted in the printing.

EXAMPLE 10

A sample of material as described in Example 4 was used through the GERBER Edge as described in Example 9. Excellent print quality was observed using this version of the Hook graphic Film. No defects were observed.

EXAMPLE 11

Example 1 was repeated, with the exception that no BYNEL material was extruded onto the smooth surface. The smooth surface in this example is polypropylene that has been Corona Treated only as in Example 1. 3M brand SCOTCHLITE® brand 580-81, 680-14 and 690-85 reflective sheeting, were laminated to the smooth surface of the web to create three samples. The samples in turn were mated to a panel covered With MILLIKEN 858028 loop material as described in Example 2. In a darkened room, a flashlight was shined on each of hook reflective graphic materials and the corresponding control sample bonded only with PSA. For each sample, the reflectivity remained visually constant. The angle of reflectivity also appeared the same. No distortion in the reflectivity was noted for any of the three samples due to the more uneven surface of the loop material, compared to the PSA sample on a flat aluminum panel.

EXAMPLE 12

Example 1 was repeated, except the web was coated with SSRP-4002J red flexographic ink (Werneke Ink, Plymouth Minn. 55447), using a PAMARCO Hand Proofer (Pamarco Inc, Roselle N.J. 07203). The ink was allowed to dry at ambient conditions for ten minutes. The test sample showed good print quality and was rated "excellent" using the Tape Snap Test.

EXAMPLE 13

Example 11 was repeated and was tested in the same manner as in Example 12. Ink adhesion was "excellent" through the Tape Snap Test, and no print quality problems were observed.

EXAMPLE 14

A coextruded sample of the web was made by extruding Shell SRD7-560 polypropylene onto a silicone belt as described in U.S. Pat. No. 5,077,870, while simultaneously from a second extruder feeding in BYNEL® 3101 resin (DuPont Inc, Wilmington, Del.) as a top layer. The resulting construction had the polypropylene pins made of SRD7-560 protruding from a web of the same material, while a thin layer of BYNEL® 3101 was bonded to the smooth side of the polypropylene. Microscope photographs showed the BYNEL® 3101 to be approximately 0.002 to 0.005 cm thick. The photographs also indicated that the two layers of polymer were independent of each other with a clear dividing line. Thus, the BYNEL material did not become part of the hook structure, and the polypropylene did not mix with the BYNEL® skin layer. Various qualitative tests such as tearing and stretching the film indicated that the BYNEL was strongly bonded to the polypropylene, and the two materials could not be separated. Use of the tape snap test did not distort or remove the BYNEL® in any way even though the PSA was firmly bonded to the BYNEL® layer.

EXAMPLE 15

Example 1 was repeated, except that the web was coated with SSKP-4009 Black Flexographic Ink (Werneke Inks) via the method described in Example 12. A good coating quality was obtained. During the Tape Snap Test, the ink remained firmly bonded to the substrate, however the BYNEL layer showed some signs of delamination from the polypropylene layer.

EXAMPLE 16

Example 14 was repeated except that the coextruded web was Corona Treated under the sane conditions as in Example 1, and Printed in the same manner as in Example 15. Good print quality was obtained, Good ink adhesion was obtained during the Tape Snap Test and no delamination of the BYNEL from the polypropylene was observed.

The invention is not limited to the above embodiments. The claims follow.

What is claimed is:

1. A method of providing a readily replaceable image graphic, comprising:

a) providing an imageable sheet comprising (i) a major surface comprising an imageable continuous surface, and (ii) an opposing major surface comprising a nonadhesive substrate mating surface comprising at least one mechanical fastener element integrally formed from said opposing major surface; and b) imaging directly onto said imageable continuous surface using an imaging process.

2. The method of claim 1, wherein the mechanical fastener element is a hook.

3. The method of claim 1, wherein the mechanical fastener element is a mushroom hook.

4. The method of claim 1, wherein the mechanical fastener element is a loop.

5. The method of claim 1, wherein the imaging process comprises printing with a UV screen print process.

6. The method of claim 1, wherein the imaging process comprises printing with a solvent based screen print process.

7. The method of claim 1, wherein the imaging process comprises printing with an electrostatic printing process.

8. The method of claim 1, wherein the imaging process comprises printing with an inkjet printing process.

9. The method of claim 1, wherein the imaging process comprises printing with a thermal transfer printing process.

10. The method of claim 1, wherein the imaging process comprises printing with a flexographic printing process.

11. A method of displaying a graphic image comprising:

a) providing an imageable sheet comprising
   (i) a major surface comprising an imageable continuous surface, and
   (ii) an opposing major surface comprising a nonadhesive substrate mating surface comprising at least one mechanical fastener elements integrally formed from said opposing major surface;

b) applying a graphic image directly onto said imageable continuous surface using an imaging process; and c) applying said imageable sheet onto another nonadhesive substrate mating surface such that said mating surfaces interlock.

* * * * *